US009895907B2

(12) United States Patent
Tamaki

(10) Patent No.: US 9,895,907 B2
(45) Date of Patent: Feb. 20, 2018

(54) INKJET PRINTER

(71) Applicant: MIMAKI ENGINEERING CO., LTD., Nagano (JP)

(72) Inventor: Kazutaka Tamaki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/302,485

(22) PCT Filed: Apr. 9, 2015

(86) PCT No.: PCT/JP2015/061147

§ 371 (c)(1),
(2) Date: Oct. 6, 2016

(87) PCT Pub. No.: WO2015/156366

PCT Pub. Date: Oct. 15, 2015

(65) Prior Publication Data

US 2017/0028745 A1 Feb. 2, 2017

(30) Foreign Application Priority Data

Apr. 9, 2014 (JP) ..... 2014-080101

(51) Int. Cl.

| | |
|---|---|
| ***B41J 11/08*** | (2006.01) |
| ***B41J 11/14*** | (2006.01) |
| ***B41J 11/20*** | (2006.01) |
| ***B41J 11/00*** | (2006.01) |
| ***B41J 11/06*** | (2006.01) |
| ***B41J 2/01*** | (2006.01) |

(52) U.S. Cl.

CPC ..... *B41J 11/14* (2013.01); *B41J 2/01* (2013.01); *B41J 11/0085* (2013.01); *B41J 11/06* (2013.01); *B41J 11/08* (2013.01); *B41J 11/20* (2013.01)

(58) Field of Classification Search

CPC ..... B41J 11/004; B41J 11/0085; B41J 11/08; B41J 11/14; B41J 3/4078

See application file for complete search history.

(56) References Cited

U.S. PATENT DOCUMENTS

2005/0093951 A1* 5/2005 Takatsuka ..... B41J 2/16585 347/101

FOREIGN PATENT DOCUMENTS

| | | |
|---|---|---|
| JP | H02286340 | 11/1990 |
| JP | 2007168206 | 7/2007 |

OTHER PUBLICATIONS

"International Search Report (Form PCT/ISA/210)", dated Jul. 7, 2015, with English translation thereof, pp. 1-2.

(Continued)

*Primary Examiner* — Kristal Feggins
*Assistant Examiner* — Kendrick Liu
(74) *Attorney, Agent, or Firm* — JCIPRNET

(57) ABSTRACT

An inkjet printer is an inkjet printer for performing printing on a print medium, and includes: a platen, having a groove formed at a position facing an inkjet head and configured to support a print medium; an air blowing unit, for sucking air from an inside of the groove; a lid, attachable to and detachable from the platen and configured to cover an opening of the groove and support the print medium by a surface of the lid when attached to the platen; a storage part, for storing the lid detached from the platen; and a link mechanism, for guiding movement of the lid between the platen and the storage part.

5 Claims, 14 Drawing Sheets

(56) References Cited

OTHER PUBLICATIONS

"Search Report of Europe Counterpart Application", dated Apr. 25, 2017, p. 1-p. 7.

* cited by examiner

INKJET PRINTER

CROSS-REFERENCE TO RELATED APPLICATION

This application is a 371 application of the international PCT application serial no. PCT/JP2015/061147, filed on Apr. 9, 2015, which claims the priority benefits of Japan application no. JP 2014-080101, filed on Apr. 9, 2014. The entirety of each of the above-mentioned patent applications is hereby incorporated by reference herein and made a part of this specification.

TECHNICAL FIELD

The present invention relates to an inkjet printer for performing printing on print media.

BACKGROUND ART

As an inkjet printer of the related art, there has been known an inkjet printer which has an inkjet head for ejecting ink drops toward a print medium, a platen configured to have a groove formed at a position facing the inkjet head and support the print medium, a medium conveyer for conveying the print medium supported by the platen, and an air suction device for sucking air from the inside of the groove of the platen (see Patent Literature 1). The platen of this inkjet printer is for supporting a print medium disposed between the inkjet head and the groove.

The inkjet printer of the related art can perform printing on mesh-like print media (hereinafter, referred to as mesh media) such as fabrics. In the inkjet printer of the related art, a portion of ink drops ejected from the inkjet head toward a mesh medium adheres to a surface of the mesh medium, thereby forming a print image on the surface of the mesh medium. However, the other portion of the ink drops oozes out of the rear surface side of the mesh medium, that is, the opposite side of the mesh medium to the inkjet head side, through the mesh medium. In a case where the inkjet printer of the related art performs printing on a mesh medium, ink which is a portion of ink drops ejected from the inkjet head and oozes out of the mesh medium is collected in the groove of the platen. Therefore, it is possible to suppress the ink ejected from the inkjet head and oozing out of the mesh medium from staining the mesh medium. Also, in a case where the inkjet printer of the related art performs printing on a mesh medium, air is sucked from the inside of the groove of the platen by the air suction device, whereby ink drops ejected from the inkjet head are sucked toward the groove of the platen through the mesh medium. Therefore, it is possible to suppress wind pressure exerted by scanning of the inkjet head from causing the flight routes of ink drops to be curved or causing ink drops to be dispersed into a fine mist. Therefore, the inkjet printer of the related art can perform high-quality printing on mesh media.

CITATION LIST

Patent Literature

Patent Literature 1: JP-A-2007-168206

SUMMARY

Technical Problem

However, the inkjet printer of the related art has the groove formed at the position facing the inkjet head. Therefore, even in a case of performing printing on a print medium which is not a mesh-like medium (hereinafter, referred to as a non-mesh medium) such as paper, at the position facing the inkjet head, the non-mesh medium is not directly supported from the opposite side to the inkjet head side. For this reason, the inkjet printer of the related art cannot keep the distance between the inkjet head and the non-mesh medium at the position facing the inkjet head, within a specific range. Therefore, in order to prevent contact between the inkjet head and the non-mesh medium, it is required to space the inkjet head sufficiently far from the non-mesh medium. In a case where the inkjet head is sufficiently far from the non-mesh medium, it is difficult to attach ink drops to the non-mesh medium with high accuracy. Therefore, the inkjet printer of the related art has a problem that the quality of printing on non-mesh media is not high.

With respect to the inkjet printer of the related art, in order to perform high-quality printing not only on mesh media but also on non-mesh media, it can be considered to provide a lid configured to detachably cover the opening of the groove of the platen so as to support a non-mesh medium by its surface. In other words, the inkjet printer of the related art needs only to be modified to perform printing on mesh media in a state where the lid has been detached from the platen and perform printing on non-mesh media in a state where the lid has been attached to the platen.

However, in a case where the inkjet printer having the lid attachable to and detachable from the platen performs printing on a non-mesh medium in the state where the lid has been attached to the platen, there is a probability that the non-mesh medium is waved or curls, whereby the non-mesh medium rises from the lid. However, spacing the inkjet head sufficiently far from the non-mesh medium in order to prevent contact between the inkjet head and the non-mesh medium due to such rising deteriorates the quality of printing on the non-mesh medium as described above. Therefore, in order to prevent a non-mesh medium from rising from the lid in a case where the inkjet printer having the lid attachable to and detachable from the platen performs printing on the non-mesh medium in a state where the lid has been attached to the platen, it is required to suck and hold the non-mesh medium by the lid.

Also, in a case where only one lid attachable to and detachable from the platen is provided to the inkjet printer, as compared to a configuration in which a plurality of lids is provided and a step between lids can be generated, since it is possible to keep the surface flatness of the entire lid within a specific range, it is possible to perform high-quality printing on non-mesh media.

Meanwhile, recently, with respect to inkjet printers, with diversification of their applications and print media, growth in size has been proceeding at a rapid rate. Therefore, in a case where only one lid attachable to and detachable from a platen is provided to a large-sized inkjet printer, since the width of the lid is longer than the arm span of a user and is, for example, 3.2 m, there is a probability that a case where it is difficult for the user to attach or detach the lid alone occurs.

It is therefore an object of the present invention to provide an inkjet printer capable of making it easy for a user to attach or detach an attachable and detachable lid for making it possible to high-quality printing not only on mesh media but also non-mesh media.

Solution to Problem

An inkjet printer of the present invention is an inkjet printer for performing printing a print medium which includes an inkjet head configured to eject ink drops toward a print medium, a platen configured to have a groove formed at a position facing the inkjet head, and support the print medium, a medium conveyer configured to convey the print medium supported on the platen, an air suction device configured to suck air from the inside of the groove, a lid configured to be attachable to and detachable from the platen, and cover an opening of the groove and support the print medium by its surface when attached to the platen, a storage part for storing the lid detached from the platen, and a guide mechanism configured to guide movement of the lid between the platen and the storage part, wherein the lid has a plurality of through-holes formed in the surface for allowing air to pass therein from the outside of the groove toward the inside of the groove in a case where air is sucked from the inside of the groove by the suction device in a state where the lid has been attached to the platen.

According to this configuration, since the inkjet printer of the present invention guides movement of the lid between the platen to which the attachable and detachable lid for making it possible to perform high-quality printing not only on mesh media but also on non-mesh media is attached, and the storage part for storing the lid detached from the platen, it is possible to make it easy for a user to attach and detach the lid.

Also, in the inkjet printer of the present invention, the guide mechanism may be a link mechanism.

According to this configuration, since the guide mechanism can be implemented by a simple configuration as compared to a configuration in which the guide mechanism is a mechanical mechanism other than the link mechanism, the size of the inkjet printer of the present invention does not increase.

Also, in the inkjet printer of the present invention, the link mechanism may have a pair of links supported so as to be rotatable around a shaft perpendicular to their extension direction and disposed in parallel to each other with the lid interposed therebetween, and the pair of links may have long holes formed so as to face each other, and the lid may have shaft parts formed on both sides in a direction perpendicular to the extension direction of the links and to be inserted into the long holes so as to be rotatable, and the shaft parts may be slidable along the long holes.

According to this configuration, in the inkjet printer of the present invention, since the shaft parts of the lid are slidable along the long holes of the links with respect to the links, it is possible to provide the storage part in the vicinity of the platen, as compared to a configuration in which the shaft parts of the lid are not slidable with respect to the links. Therefore, the size of the inkjet printer of the present invention does not increase.

Also, the lid may be the only lid which the inkjet printer of the present invention has.

According to this configuration, in a case where the inkjet printer of the present invention performs printing on a non-mesh medium in a state where the lid has been attached to the platen, as compared to a configuration in which a plurality of lids is provided and a gap between lids can be formed, since it is possible to uniformize the suction state of the non-mesh medium through the through-holes of the lid, over the entire lid, regardless of place, it is possible to perform high-quality printing on the non-mesh medium. Also, in a case where the inkjet printer of the present invention performs printing on a non-mesh medium in the state where the lid has been attached to the platen, as compared to a configuration in which a plurality of lids is provided and a step between lids can be generated, since it is possible to keep the surface flatness of the entire lid within a specific range, it is possible to perform high-quality printing on the non-mesh medium. Especially, in a case where the inkjet printer of the present invention is a large-sized printer, although the only one lid provided becomes large and heavy, since it is possible to easily guide an operation of attaching the lid stored in the storage part to the platen, and an operation of storing the lid detached from the platen in the storage part, by the guide mechanism, the advantage which is obtained that the inkjet printer has the guide mechanism is great.

Also, in the inkjet printer of the present invention, the inkjet head may be disposed on the upper side in a vertical direction with respect to a conveyance path of the print medium by the medium conveyer, and the storage part may be disposed on the lower side in the vertical direction with respect to the conveyance path.

In an inkjet printer, a space on the lower side in a vertical direction where any inkjet head does not exist may be empty. In the inkjet printer of the present invention, since the lid detached from the platen is stored in a space on the lower side in the vertical direction, whereby it is possible to effectively use the space on the lower side in the vertical direction, the size does not increase as compared to a configuration in which the lid detached from the platen is stored in a space on the upper side in the vertical direction where the inkjet heads exist.

Also, the inkjet printer of the present invention may include an attachment/detachment state detector configured to detect the attachment/detachment state of the lid relative to the platen. Further, in a case where it is detected by the attachment/detachment state detector that the lid has been attached to the platen, the air suction device may suck air from the inside of the groove with a stronger suction force as compared to a case where it is detected by the attachment/detachment state detector that the lid has been detached from the platen.

According to this configuration, in a case of performing printing on a mesh medium in the state where the lid has been detached from the platen, since the inkjet printer of the present invention sucks air from the inside of the groove of the platen with a weaker suction force by the air suction device, as compared to a case of performing printing on a non-mesh medium in the state where the lid has been attached to the platen, it is possible to suppress the mesh medium from greatly bending toward the groove of the platen. Therefore, the inkjet printer of the present invention can perform high-quality printing on the mesh medium. Also, in a case of performing printing on a non-mesh medium in the state where the lid has been attached to the platen, the inkjet printer of the present invention sucks air from the inside of the groove of the platen with a stronger suction force as compared to a case of performing printing on a mesh medium in the state where the lid has been detached from the platen. Therefore, it is possible to improve a function of suppressing rising of non-mesh media from the lid. Therefore, the inkjet printer of the present invention can perform high-quality printing on the non-mesh medium. In other words, since the inkjet printer of the present invention sucks air from the inside of the groove of the platen with appropriate suction forces for mesh media and non-mesh media by the air suction device, it is possible to perform high-quality printing not only on mesh media but also on non-mesh media.

Advantageous Effects of Invention

The inkjet printer of the present invention can make it easier for a user to attach or detach an attachable and detachable lid for making it possible to perform high-quality printing not only on mesh media but also non-mesh media.

BRIEF DESCRIPTION OF DRAWINGS

FIG. 7(*b*) is a view illustrating the next process of FIG. 7(*a*).

FIG. 8(*b*) is a view illustrating the next process of FIG. 8(*a*).

FIG. 12(*b*) is a view illustrating the next process of FIG. 12(*a*).

FIG. 13(*b*) is a view illustrating the next process of FIG. 13(*a*).

DESCRIPTION OF EMBODIMENTS

Hereinafter, embodiments of the present invention will be described with reference to drawings.

(First Embodiment)

First, the configuration of an inkjet printer according to a first embodiment of the present invention will be described.

Figure 1:
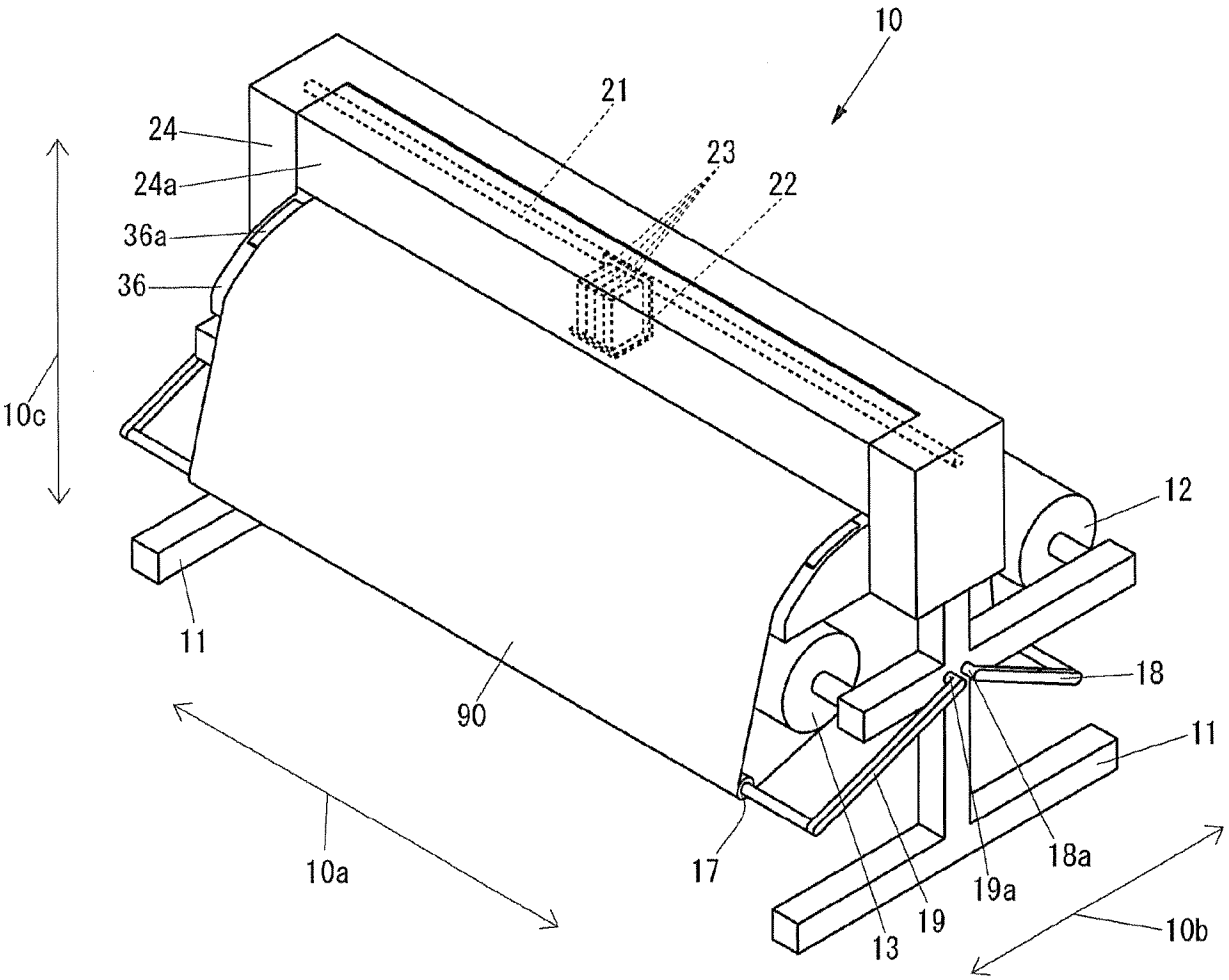
FIG. 1 is a perspective view of the external appearance of an inkjet printer according to a first embodiment of the present invention.
Figure 2:
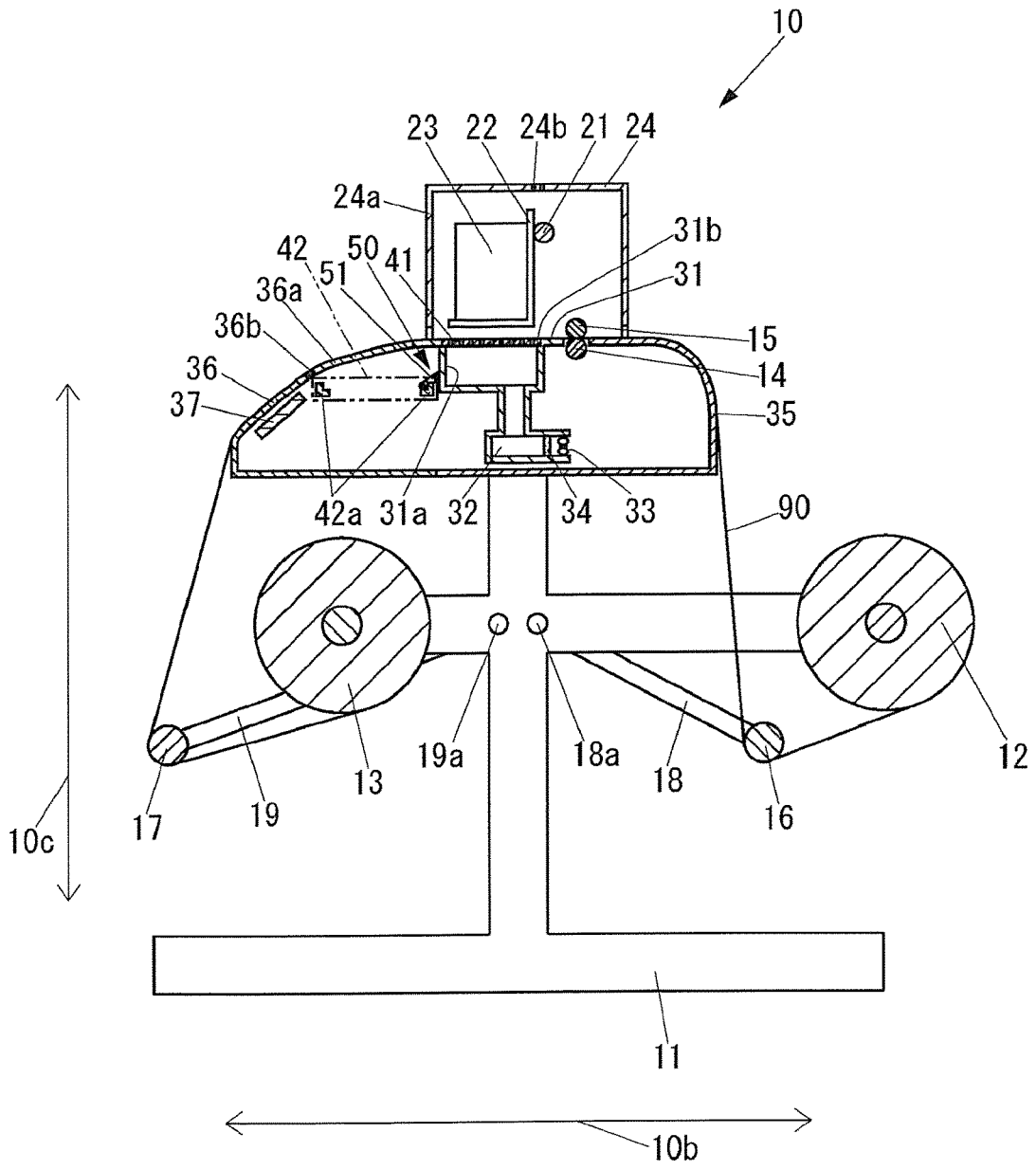
FIG. 2 is a sectional side view of the inkjet printer shown in FIG. 1.

FIG. 1 is a perspective view of the external appearance of an inkjet printer 10 according to the present embodiment. FIG. 2 is a sectional side view of the inkjet printer 10.

As shown in FIG. 1 and FIG. 2, the inkjet printer 10 includes a supporting part 11, an unwinding roller 12, a winding roller 13, a grid roller 14, a pinch roller 15, a tension bar 16, a tension bar 17, a rotation support unit 18, and a rotation support unit 19.

The supporting part 11 is installed on a floor. The unwinding roller 12 is for winding a print medium 90 before printing and unwinding the print medium 90. The winding roller 13 is for winding the print medium 90 after printing. The grid roller 14 is a medium conveyer for conveying the print medium 90 from the unwinding roller 12 toward the winding roller 13. The pinch roller 15 nips the print medium 90 together with the grid roller 14. The tension bar 16 applies a tension to the print medium 90 at a position between the unwinding roller 12 and the grid roller 14. The tension bar 17 applies a tension to the print medium 90 at a position between the winding roller 13 and the grid roller 14. The rotation support unit 18 is supported on the supporting part 11 so as to be rotatable around a shaft 18*a* extending in a main scan direction shown by an arrow 10*a*, and supports the tension bar 16 such that the tension bar is rotatable. The rotation support unit 19 is supported on the supporting part 11 so as to be rotatable around a shaft 19*a* extending in the main scan direction, and supports the tension bar 17 such that the tension bar is rotatable.

The unwinding roller 12 and the winding roller 13 extend in the main scan direction shown by the arrow 10*a*, and are supported on the supporting part 11 so as to be rotatable.

The grid roller 14 and the pinch roller 15 extend in the main scan direction shown by the arrow 10*a*, and are supported so as to be rotatable.

The tension bar 16 and the tension bar 17 extend in the main scan direction shown by the arrow 10*a*.

Figure 3:
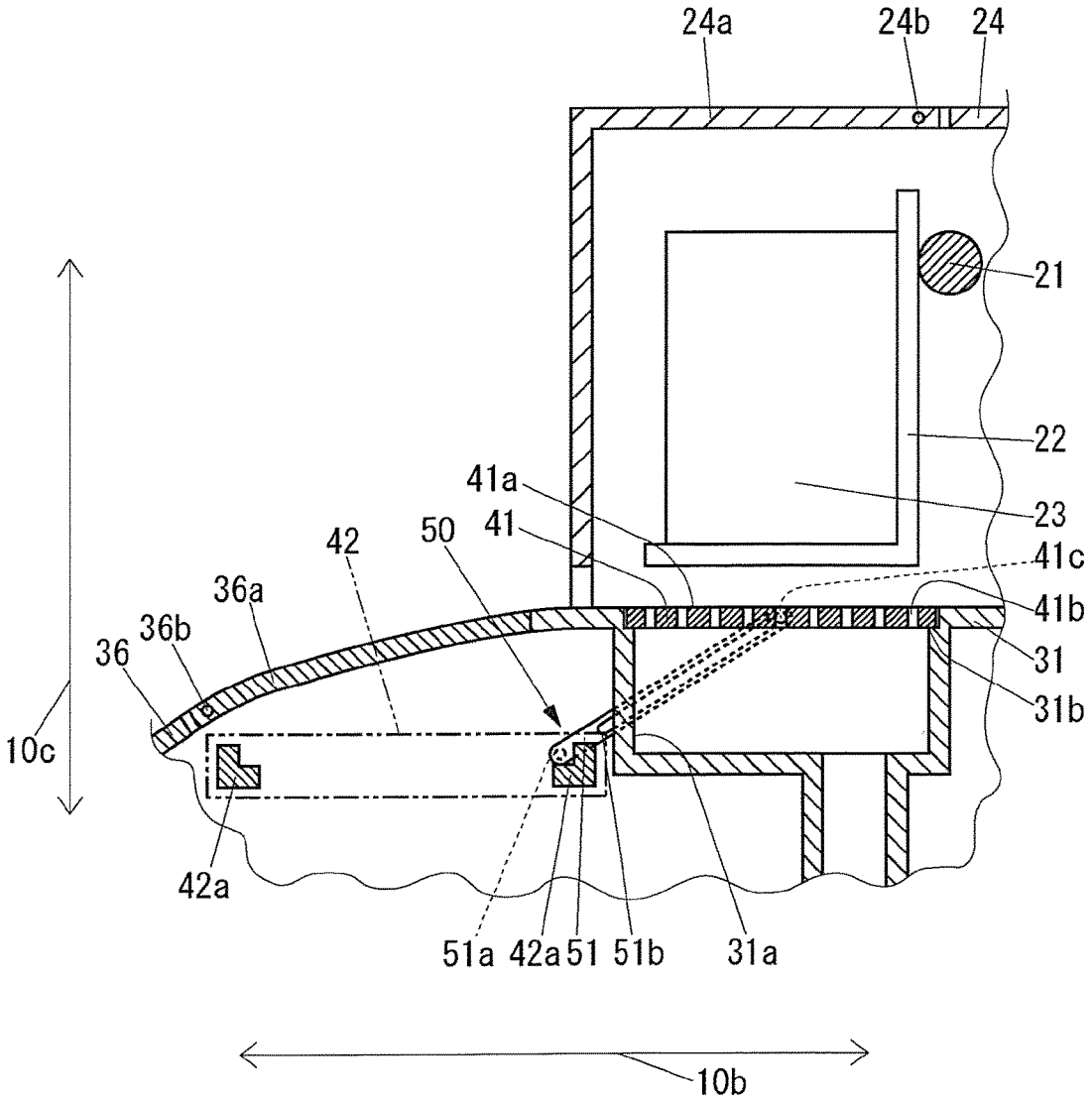
FIG. 3 is a sectional side view of an area including a platen shown in FIG. 2.

FIG. 3 is a sectional side view of an area including a platen 31 to be described below.

As shown in FIG. 1 and FIG. 3, the inkjet printer 10 includes a guide rail 21 extending in the main scan direction shown by the arrow 10*a*, a carriage 22 supported on the guide rail 21 so as to be movable in the main scan direction, a plurality of inkjet heads 23 mounted on the carriage 22 and configured to eject ink drops toward the print medium 90, and a case 24 for covering the guide rail 21, the carriage 22, and the inkjet heads 23.

The inkjet heads 23 are disposed above a conveyance path of the print medium 90 by the grid roller 14, in a vertical direction shown by an arrow 10*c* and perpendicular to both of the main scan direction shown by the arrow 10*a* and a sub scan direction shown by an arrow 10*b* and perpendicular to the main scan direction.

The case 24 has an opening/closing part 24*a* which is openable and closable. The opening/closing part 24*a* can be opened and closed around a shaft 24*b* extending in the main scan direction shown by the arrow 10*a*.

As shown in FIG. 1 to FIG. 3, the inkjet printer 10 includes the platen 31, an ink storage part 32, an air blowing unit 33, a filter 34, an upstream-side supporting part 35, a downstream-side supporting part 36, and an after-heater 37.

The platen 31 has a groove 31*a* formed at a position facing the inkjet heads 23, and supports the print medium 90. The ink storage part 32 collects ink having dropped into the groove 31*a* of the platen 31. The air blowing unit 33 is an air suction device for sucking air from the inside of the groove 31*a* of the platen 31, such as a fan or a blower. The filter 34 is installed in the ink storage part 32 and prevents ink from entering the air blowing unit 33. The upstream-side supporting part 35 is positioned on the upstream side from the platen 31 in the conveyance direction of the print medium 90 from the unwinding roller 12 toward the winding roller 13, and supports the print medium 90. The downstream-side supporting part 36 is positioned on the downstream side from the platen 31 in the conveyance direction of the print medium 90 from the unwinding roller 12 toward the winding roller 13, and supports the print medium 90. The after-heater 37 is disposed inside the downstream-side supporting part 36, and dries ink on the print medium 90 supported on the downstream-side supporting part 36.

The platen 31 supports the print medium 90 which is conveyed in the sub scan direction shown by the arrow 10*b* by the grid roller 14. The platen 31 is for supporting a part of the print medium 90 disposed between the inkjet heads 23 and the groove 31*a*.

The formation direction of the groove 31*a* of the platen 31 is perpendicular to the conveyance direction of the print medium 90 which is positioned above the groove 31*a* in the vertical direction shown by the arrow 10*c*.

The downstream-side supporting part 36 has an opening/closing part 36*a* which is openable and closable. The opening/closing part 36*a* can be opened and closed around a shaft 36*b* extending in the main scan direction shown by the arrow 10*a*. Also, although not shown, the after-heater 37 can be installed on the opening/closing part 36*a*.

The inkjet printer 10 has a lid 41 attachable to and detachable from the platen 31. The lid 41 is configured to cover an opening 31*b* of the groove 31*a* of the platen 31 so as to support the print medium 90 by its surface 41*a* when attached to the platen 31.

Also, the groove 31*a* of the platen 31 needs to be sealed so as to be airtight to a certain extent by the lid 41 in a case where the lid 41 is covering the opening 31*b*.

Figure 4:
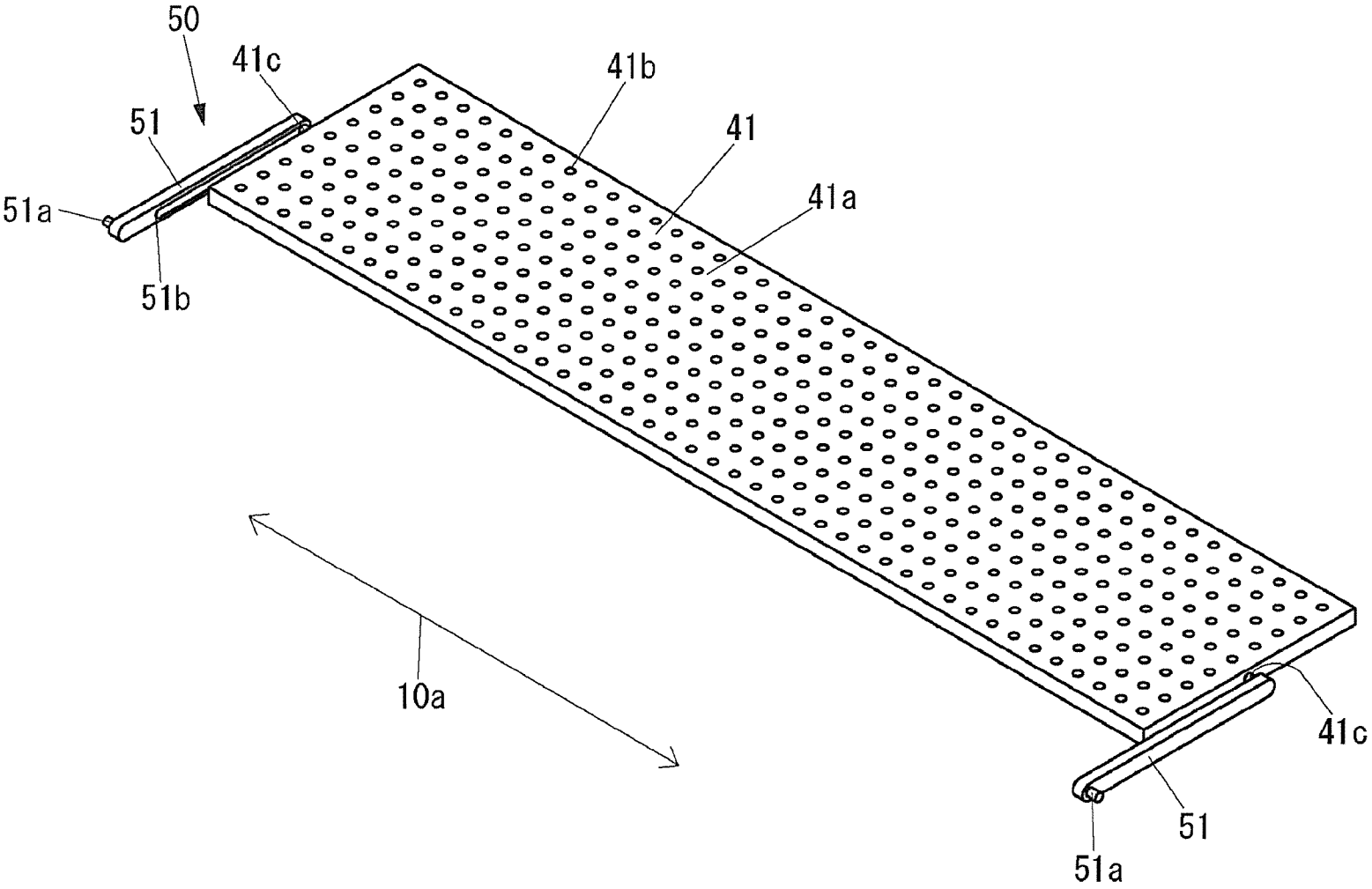
FIG. 4 is a perspective view of a lid and a link mechanism shown in FIG. 3.

FIG. 4 is a perspective view of the lid 41 and a link mechanism 50 to be described below.

As shown in FIG. 3 and FIG. 4, the lid 41 has a plurality of suction holes 41*b* formed in the surface 41*a*. The lid 41 has shaft parts 41*c* positioned on both sides in the main scan direction and extending in the main scan direction shown by the arrow 10*a*. The suction holes 41*b* are through-holes for allowing air to pass therein from the outside of the groove 31*a* toward the inside of the groove 31*a* in a case where air is sucked from the inside of the groove 31*a* of the platen 31 by the air blowing unit 33 (see FIG. 2) in a state where the lid 41 has been attached to the platen 31.

As shown in FIG. 2 and FIG. 3, the inkjet printer 10 has a storage part 42 for storing the lid 41 detached from the platen 31. The storage part 42 is disposed below the conveyance path of the print medium 90 by the grid roller 14, in the vertical direction shown by the arrow 10*c*. The storage part 42 has a mounting rack 42*a* where the lid 41 can be mounted. The mounting rack 42*a* is supported by a member (not shown) so as not to move in any direction of the main scan direction shown by the arrow 10*a*, the sub scan direction shown by the arrow 10*b*, and the vertical direction, with respect to the downstream-side supporting part 36.

The inkjet printer 10 has the link mechanism 50 as a guide mechanism for guiding movement of the lid 41 between the platen 31 and the storage part 42.

As shown in FIG. 3 and FIG. 4, the link mechanism 50 has a pair of links 51 disposed so as to be parallel to each other with the lid 41 interposed therebetween.

The links 51 have shafts 51*a* extending in the main scan direction shown by the arrow 10*a* and perpendicular to the extension direction of the links 51. The shafts 51*a* are rotatably supported by a member (not shown) so as not to move in any direction of the main scan direction, the sub scan direction shown by the arrow 10*b*, and the vertical direction shown by the arrow 10*c*, with respect to the downstream-side supporting part 36.

The pair of links 51 have long holes 51*b* facing each other. The shaft parts 41*c* of the lid 41 are inserted into the long holes 51*b* of the links 51, and are rotatable inside the long holes 51*b*, and are slidable along the long holes 51*b*.

Figure 5:
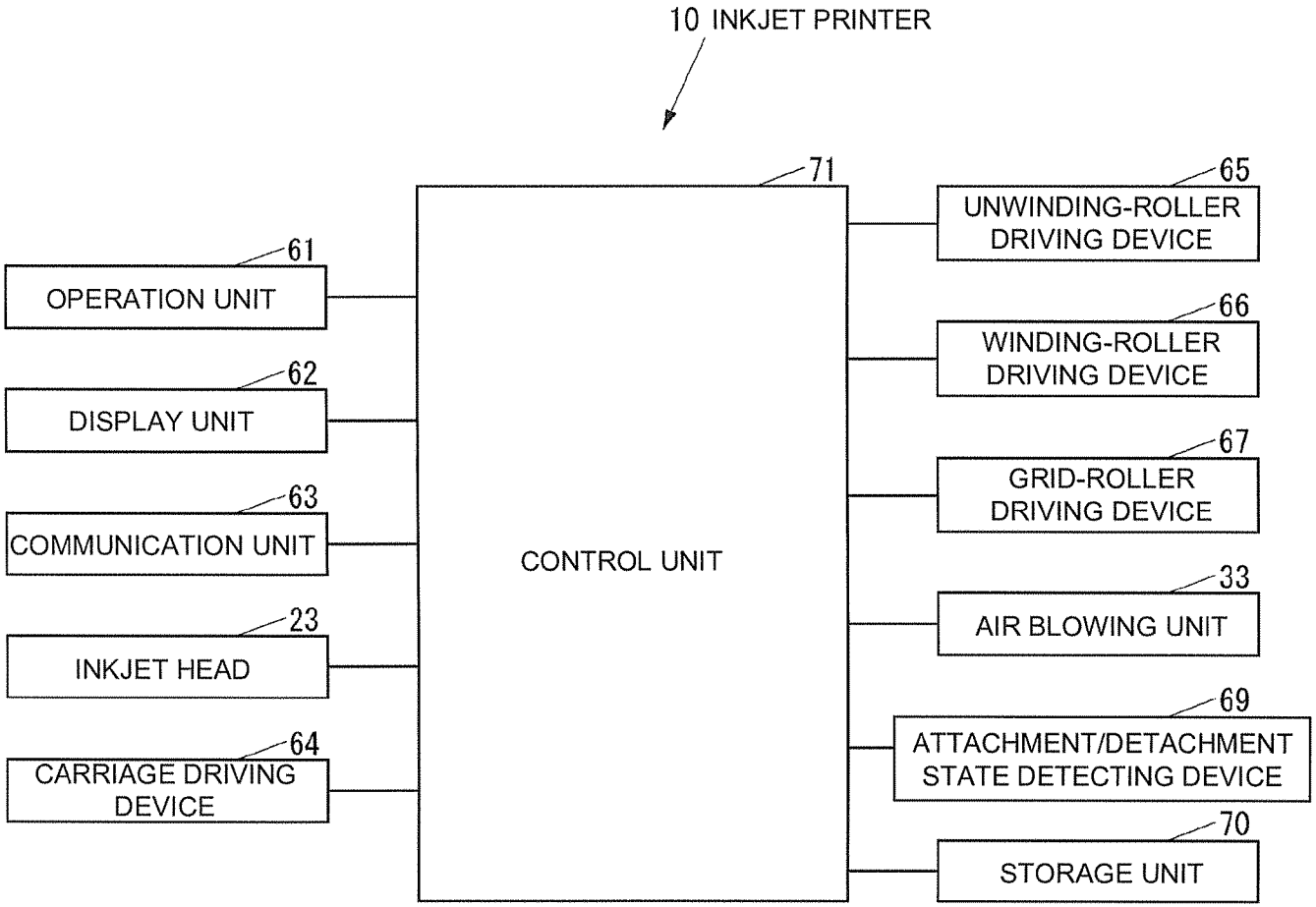
FIG. 5 is a block diagram of the inkjet printer shown in FIG. 1.

FIG. 5 is a block diagram of the inkjet printer 10.

As shown in FIG. 5, the inkjet printer 10 includes an operation unit 61, a display unit 62, a communication unit 63, the above-described inkjet heads 23, a carriage driving device 64, a unwinding-roller driving device 65, a winding-roller driving device 66, a grid-roller driving device 67, the above-described air blowing unit 33, an attachment/detachment state detector 69, a storage unit 70, and a control unit 71.

The operation unit 61 is an input device of buttons and the like on which various operations can be input. The display unit 62 is a display device such as an LCD (Liquid Crystal Display) for displaying a variety of information. The communication unit 63 is a communication device for performing communication with external devices such as a PC (Personal Computer). The carriage driving device 64 moves the carriage 22 (see FIG. 1) in the main scan direction shown by the arrow 10*a* (see FIG. 1) along the guide rail 21 (see FIG. 1). The unwinding-roller driving device 65 rotates the unwinding roller 12 (see FIG. 1). The winding-roller driving device 66 rotates the winding roller 13 (see FIG. 1). The grid-roller driving device 67 rotates the grid roller 14 (see FIG. 2). The attachment/detachment state detector 69 detects the attachment/detachment state of the lid 41 (see FIG. 2) related to the platen 31 (see FIG. 2). The storage unit 70 is a storage device for storing a variety of data, such as an EEPROM (Electrically Erasable Programmable Read Only Memory). The control unit 71 controls the whole of the inkjet printer 10.

The attachment/detachment state detector 69 may have any configuration as long as it can detect the attachment/detachment state of the lid 41 related to the platen 31. For example, the attachment/detachment state detector 69 may be a contact-type sensor which comes into contact with the lid 41 in a case where the lid 41 is attached to the platen 31, and may be a contactless sensor for detecting the lid 41 attached to the platen 31, such as an optical sensor.

The control unit 71 has, for example, a CPU (Central Processing Unit), a ROM (Read Only Memory) retaining programs and a variety of data in advance, and a RAM (Random Access Memory) usable as a work area of the CPU. The CPU is configured to sequentially read out and execute programs stored in the ROM or the storage unit 70.

The control unit 71 controls the carriage driving device 64 such that the carriage driving device moves the carriage 22 in the main scan direction shown by the arrow 10*a* along the guide rail 21, thereby relatively moving the inkjet heads 23 mounted on the carriage 22, in the main scan direction with respect to the print medium 90. At this time, the control unit 71 ejects ink drops toward the print medium 90 by the inkjet heads 23, thereby performing printing in the main scan direction. Further, whenever printing in the main scan direction finishes, the control unit 71 controls the grid-roller driving device 67 such that the grid-roller driving device rotates the grid roller 14, thereby moving the print medium 90 nipped by the grid roller 14 and the pinch roller 15 (see FIG. 3) in the sub scan direction shown by the arrow 10*b* (see FIG. 1).

In other words, the control unit 71 moves the print medium 90 in the sub scan direction, thereby relatively changing the printing position of the print medium 90 relative to the inkjet heads 23 in the sub scan direction.

Then, the control unit 71 re-performs printing in the main scan direction, on the new printing position in the sub scan direction. As described above, the print medium 90 is conveyed in the sub scan direction with respect to the inkjet heads 23 by a predetermined amount for each conveyance time, whereby printing passes are configured. Also, in response to conveyance of the print medium 90 by the grid-roller driving device 67, the control unit 71 controls the unwinding-roller driving device 65 at a predetermined timing, such that the unwinding-roller driving device rotates the unwinding roller 12, whereby the print medium 90 to be conveyed by the grid roller 14 is unwound from the unwinding roller 12. Also, in response to conveyance of the print medium 90 by the grid-roller driving device 67, the control unit 71 controls the winding-roller driving device 66 at a predetermined timing, such that the winding-roller driving device rotates the winding roller 13, whereby the print medium 90 subjected to printing by the inkjet heads 23 is wounded around the winding roller 13.

Now, an operation of the inkjet printer 10 will be described.

If the control unit 71 of the inkjet printer 10 receives print data transmitted from the outside through the communication unit 63, it controls the inkjet heads 23, the carriage driving device 64, the unwinding-roller driving device 65, the winding-roller driving device 66, and the grid-roller driving device 67 as described above on the basis of the print data, thereby performing printing by the inkjet heads 23.

In a case of performing printing by the inkjet heads 23, the control unit 71 drives the air blowing unit 33, thereby sucking out air from the groove 31*a* of the platen 31 by the air blowing unit 33. At this time, the control unit 71 performs an operation shown in FIG. 6.

Figure 6:
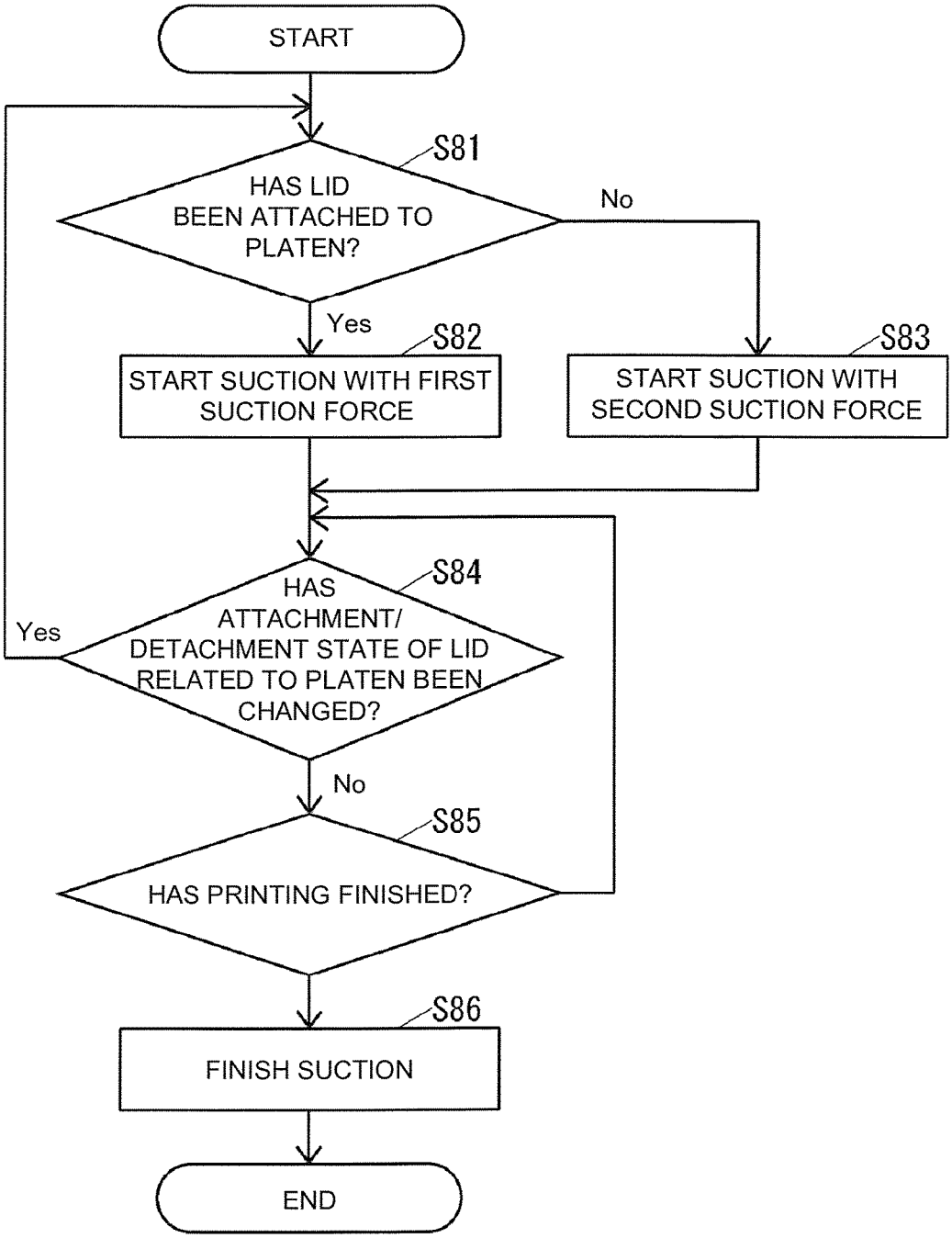
FIG. 6 is a flow chart of an operation of the inkjet printer shown in FIG. 1 in a case of driving an air blowing unit.

FIG. 6 is a flow chart of the operation of the inkjet printer 10 in a case of driving the air blowing unit 33.

As shown in FIG. 6, the control unit 71 of the inkjet printer 10 determines whether the lid 41 has been attached to the platen 31, on the basis of a detection result received from the attachment/detachment state detector 69 (STEP S81).

If it is determined in STEP S81 that the lid 41 has been attached to the platen 31, the control unit 71 starts to suck air from the inside of the groove 31*a* of the platen 31 with a first suction force by the air blowing unit 33 (STEP S82).

If it is determined in STEP S81 that the lid 41 has not been attached to the platen 31, that is, the lid 41 has been detached from the platen 31, the control unit 71 starts to suck air from the inside of the groove 31*a* of the platen 31 with a second suction force weaker than the first suction force by the air blowing unit 33.

If the process of STEP S82 or STEP S83 finishes, the control unit 71 determines whether the attachment/detachment state of the lid 41 related to the platen 31 has been changed, on the basis of a detection result received from the attachment/detachment state detector 69 (STEP S84).

If it is determined in STEP S84 that the attachment/detachment state of the lid 41 related to the platen 31 has been changed, the control unit 71 performs the process of STEP S81.

If it is determined in STEP S84 that the attachment/detachment state of the lid 41 related to the platen 31 has not been changed, the control unit 71 determines whether printing using the inkjet heads 23 has finished (STEP S85).

If it is determined in STEP S85 that printing using the inkjet heads 23 has not finished, the control unit 71 performs the process of STEP S84.

If it is determined in STEP S85 that printing using the inkjet heads 23 has finished, the control unit 71 finishes suction using the air blowing unit 33 (STEP S86), and finishes the operation shown in FIG. 6.

Now, attachment and detachment of the lid 41 relative to the platen 31 will be described.

Figure 7A:
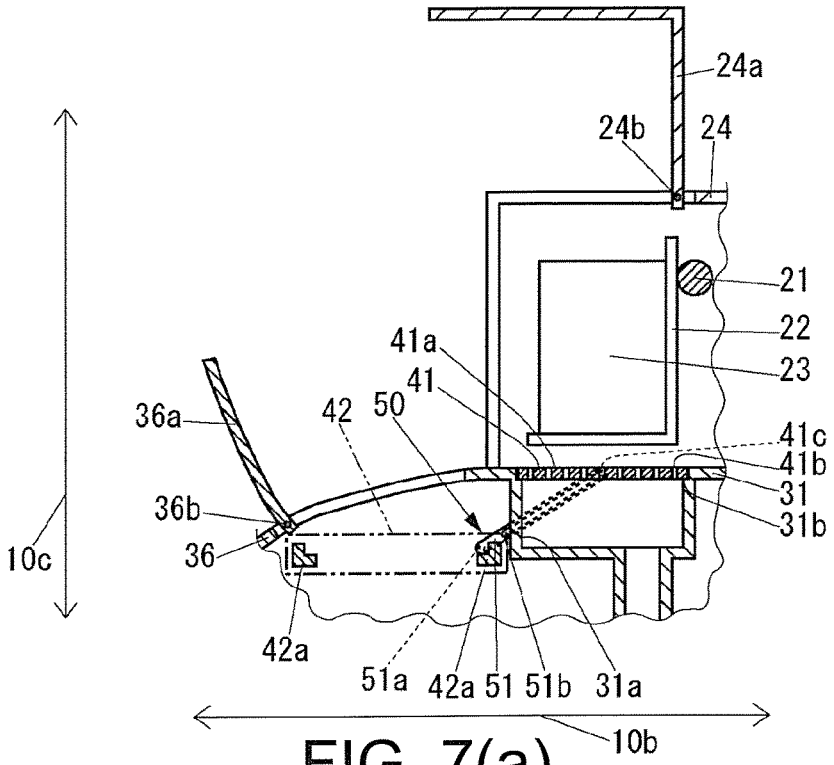
FIG. 7(*a*) is a view illustrating a first process in a case of detaching the lid from the platen.
Figure 7B:
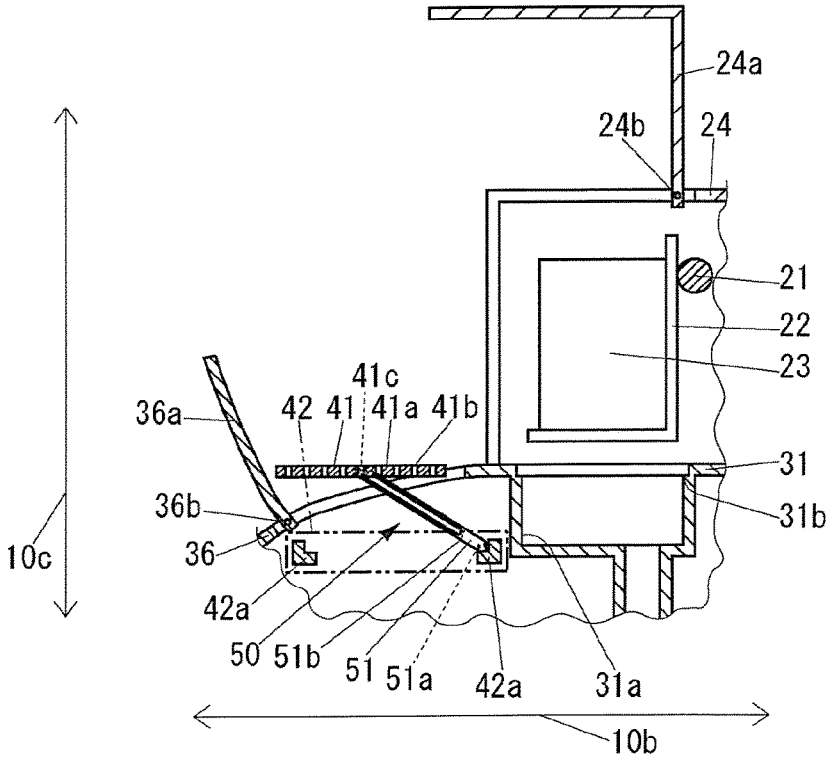

FIG. 7(*a*) is a view illustrating a first process in a case of detaching the lid 41 from the platen 31 shown in FIG. 2. FIG. 7(*b*) is a view illustrating the next process of FIG. 7(*a*). In a case of detaching the lid 41 from the platen 31 from a state where the lid 41 has been attached to the platen 31 as shown in FIG. 3, first, a user opens the opening/closing part 24*a* and the opening/closing part 36*a* as shown in FIG. 7(*a*).

Figure 8A:
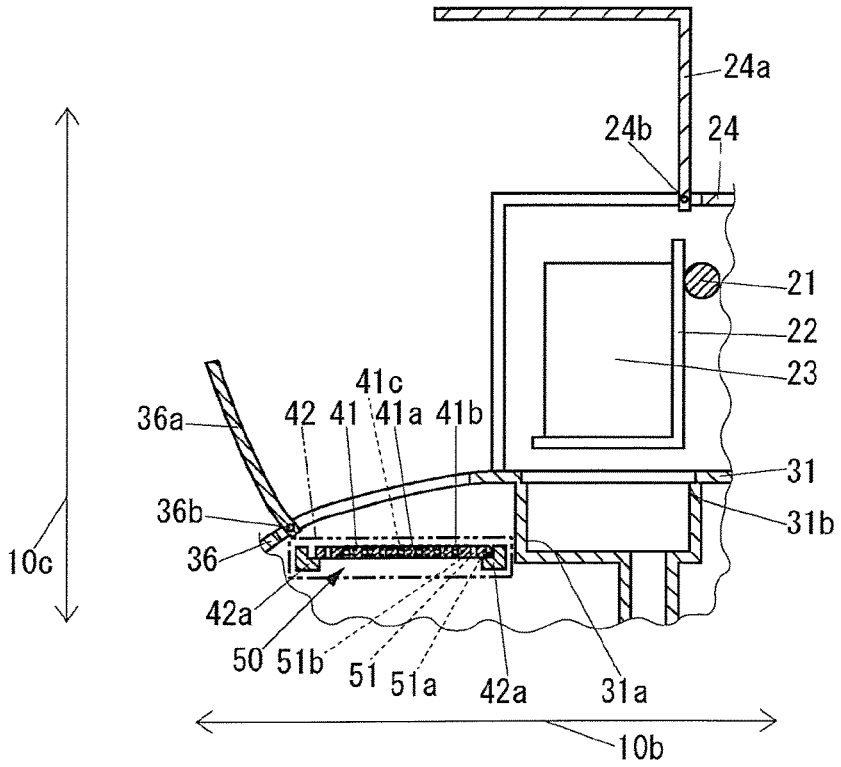
FIG. 8(*a*) is a view illustrating a second process in the case of detaching the lid from the platen.
Figure 8B:
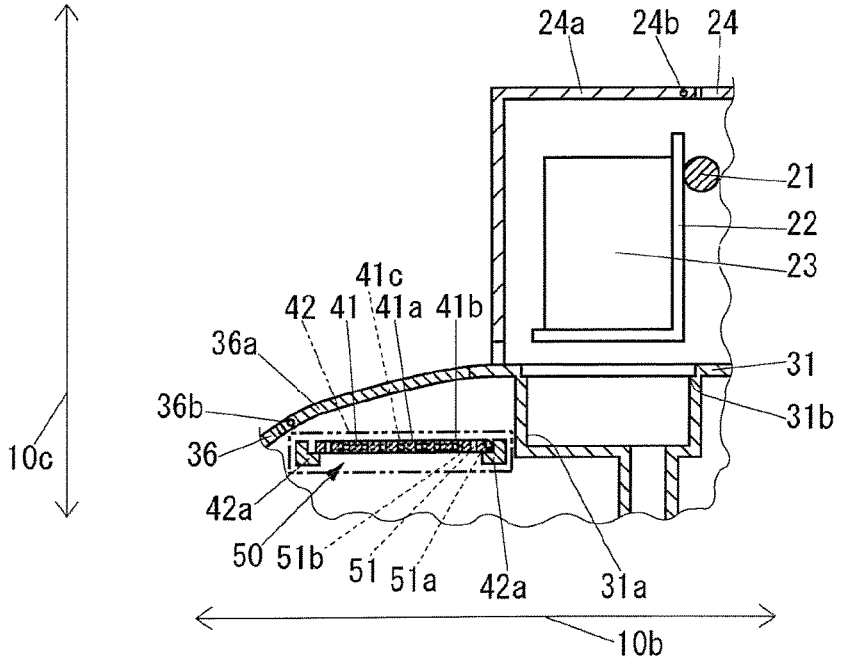

Next, the user moves the lid 41 as shown in FIG. 7(*b*) with the hands, and then stores the lid 41 in the storage part 42 as shown in FIG. 8(*a*).

FIG. 8(*a*) is a view illustrating the next process of FIG. 7(*b*). FIG. 8(*b*) is a view illustrating the next process of FIG. 8(*a*). Finally, the user closes the opening/closing part 24*a* and the opening/closing part 36*a* as shown in FIG. 8(*b*).

In a case of attaching the lid 41 to the platen 31 from a state where the lid 41 has been stored in the storage part 42 as shown in FIG. 8(*b*), the user can attach the lid 41 to the platen 31 in the reverse procedure to that in the case of detaching the lid 41 from the platen 31.

Also, in a case of making the inkjet printer 10 perform printing on a mesh medium as the print medium 90, the user stores the lid 41 in the storage part 42 as shown in FIG. 8(*b*), and then makes the inkjet printer 10 perform printing. Also, in a case of making the inkjet printer 10 perform printing on a non-mesh medium as the print medium 90, the user attaches the lid 41 to the platen 31 as shown in FIG. 3, and then makes the inkjet printer 10 perform printing.

As described above, since the inkjet printer 10 performs printing on a mesh medium in a state where the lid 41 has been detached from the platen 31, ink drops ejected from the inkjet heads 23 are sucked toward the groove 31*a* of the platen 31 through the mesh medium by the air blowing unit 33, and ink which is a portion of ink drops ejected from the inkjet heads 23 and oozes out the mesh medium is collected in the groove 31*a* of the platen 31. Therefore, it is possible to suppress the ink drops ejected from the inkjet heads 23 and oozing out the mesh medium from staining the mesh medium, and as a result, it is possible to perform high-quality printing on the mesh medium.

Also, since the inkjet printer 10 performs printing on a non-mesh medium in a state where the lid 41 has been attached to the platen 31, the non-mesh medium is sucked through the suction holes 41*b* of the lid 41 by the air blowing unit 33, thereby being suppressed from rising from the lid 41. Therefore, it is possible to perform printing in a state where the inkjet heads 23 are sufficiently close to the non-mesh medium. Therefore, the inkjet printer 10 can perform high-quality printing on the non-mesh medium.

In other words, the inkjet printer 10 can perform high-quality printing not only on mesh media but also on non-mesh media.

In the case of performing printing on the mesh medium in the state where the lid 41 has been detached from the platen 31 (STEP S83), the inkjet printer 10 sucks air from the inside of the groove 31*a* of the platen 31 with a weaker force by the air blowing unit 33, as compared to the case of performing printing on the non-mesh medium in the state where the lid 41 has been attached to the platen 31 (STEP S82). Therefore, it is possible to suppress the mesh medium from greatly bending toward the groove 31*a* of the platen 31. Therefore, the inkjet printer 10 can perform high-quality printing on the mesh medium.

Also, in the case of performing printing on the non-mesh medium in the state where the lid 41 has been attached to the platen 31 (STEP S82), the inkjet printer 10 sucks air from the inside of the groove 31*a* of the platen 31 with a stronger suction force by the air blowing unit 33, as compared to the case of performing printing on the mesh medium in the state where the lid 41 has been detached from the platen 31 (STEP S83). Therefore, it is possible to improve a function of suppressing rising of non-mesh media from the lid 41. Therefore, the inkjet printer 10 can perform high-quality printing on non-mesh media.

In other words, since the inkjet printer 10 sucks air from the inside of the groove 31*a* of the platen 31 with appropriate suction forces for mesh media and non-mesh media by the air blowing unit 33, it is possible to perform high-quality printing not only on mesh media but also on non-mesh media.

However, the inkjet printer 10 may be configured to suck air from the inside of the groove 31*a* of the platen 31 with the same suction force in a case of performing printing on non-mesh media in the state where the lid 41 has been attached to the platen 31 and in a case of performing printing on mesh media in the state where the lid 41 has been detached from the platen 31.

In the inkjet printer 10, since the shaft parts 41*c* of the lid 41 are slidable along the long holes 51*b* of the links 51 with respect to the links 51, it is possible to provide the storage part 42 in the vicinity of the platen 31, as compared to a configuration in which the shaft parts 41*c* of the lid 41 are not slidable with respect to the links 51. Therefore, the size of the inkjet printer 10 does not increase. Also, in a case where inkjet printers are large-sized printers, "space saving" is often requested from users. Therefore, in a case where the inkjet printer 10 is a large-sized printer, the great advantage that the size does not increase is great.

Also, the inkjet printer 10 may have a configuration other than the configuration shown in FIG. 4, as the link mechanism 50. For example, in the inkjet printer 10, in the configuration shown in FIG. 4, the lid 41 has the shaft parts 41*c*, and the long holes 51*b* into which the shaft parts 41*c* can be inserted are formed in the link 51; however, conversely, the link 51 may have shaft parts, and the lid 41 may have long holes into which the shaft parts can be inserted. Also, in the inkjet printer 10, the links 51 may have simple holes having a diameter slightly larger than the diameter of the shaft parts 41*c*, instead of the long holes 51*b*, such that the shaft parts 41*c* of the lid 41 cannot slide with respect to the links 51.

Since the guide mechanism is the link mechanism, the inkjet printer 10 can be implemented by a simple configuration as compared to a configuration in which the guide mechanism is a mechanical mechanism other than the link mechanism, such as a mechanism using chain. Therefore, the size of the inkjet printer 10 does not increase.

Also, the inkjet printer 10 may have a mechanical mechanism other than the link mechanism, as the guide mechanism.

Since the inkjet printer 10 can guide an operation of attaching the lid 41 stored in the storage part 42 to the platen 31, and an operation of storing the lid 41 detached from the platen 31 in the storage part 42, by the link mechanism 50, it is possible to improve the workability of the user as compared to a configuration which does not have a guide mechanism such as the link mechanism 50. In other words, since the inkjet printer 10 guides movement of the lid 41 between the platen 31 which the attachable and detachable lid 41 for making it possible to perform high-quality printing not only on mesh media but also on non-mesh media is attached, and the storage part 42 for storing the lid 41 detached from the platen 31, by the link mechanism 50, it is possible to make it easier for the user to attach and detach the lid 41.

Also, since the inkjet printer 10 can make it easier for the user to attach and detach the lid 41, the user can attach and detach the lid 41 without the need for a large force. Therefore, the inkjet printer 10 can make the user safely and quickly attach and detach the lid 41.

Also, since the inkjet printer 10 has a guide mechanism such as the link mechanism 50, it can make the user accurately attach the lid 41 to the platen 31. In the inkjet printer 10, if the lid 41 is accurately attached to the platen 31, it is possible to improve the printing quality related to non-mesh media on which printing is performed in the state where the lid 41 has been attached to the platen 31.

Also, since the inkjet printer 10 has a guide mechanism such as the link mechanism 50, even if the opening/closing part 36*a* is small, it is possible to make the user easily put and take the lid 41 in and out of the storage part 42.

In the inkjet printer 10, the lid 41 detached from the platen 31 is stored in a space on the lower side in the vertical direction shown by the arrow 10*c* where the inkjet heads 23 do not exist, whereby it is possible to effectively use the space on the lower side in the vertical direction. Therefore, the size does not increase as compared to a configuration in which the lid 41 detached from the platen 31 is stored in a space on the upper side in the vertical direction where the inkjet heads 23 exist.

Also, in the inkjet printer 10, the storage part 42 is disposed on the lower side in the vertical direction shown by the arrow 10*c*, from the conveyance path of the print medium 90 by the grid roller 14, mainly, on the lower side in the vertical direction from the downstream-side supporting part 36; however, the storage part 42 may be disposed at a position different from that. For example, in the inkjet printer 10, the storage part 42 may be disposed on the lower side in the vertical direction from the conveyance path of the print medium 90 by the grid roller 14, mainly, on the lower side in the vertical direction from the upstream-side supporting part 35, or may be disposed on the upper side in the vertical direction from the conveyance path of the print medium 90 by the grid roller 14.

Figure 9:
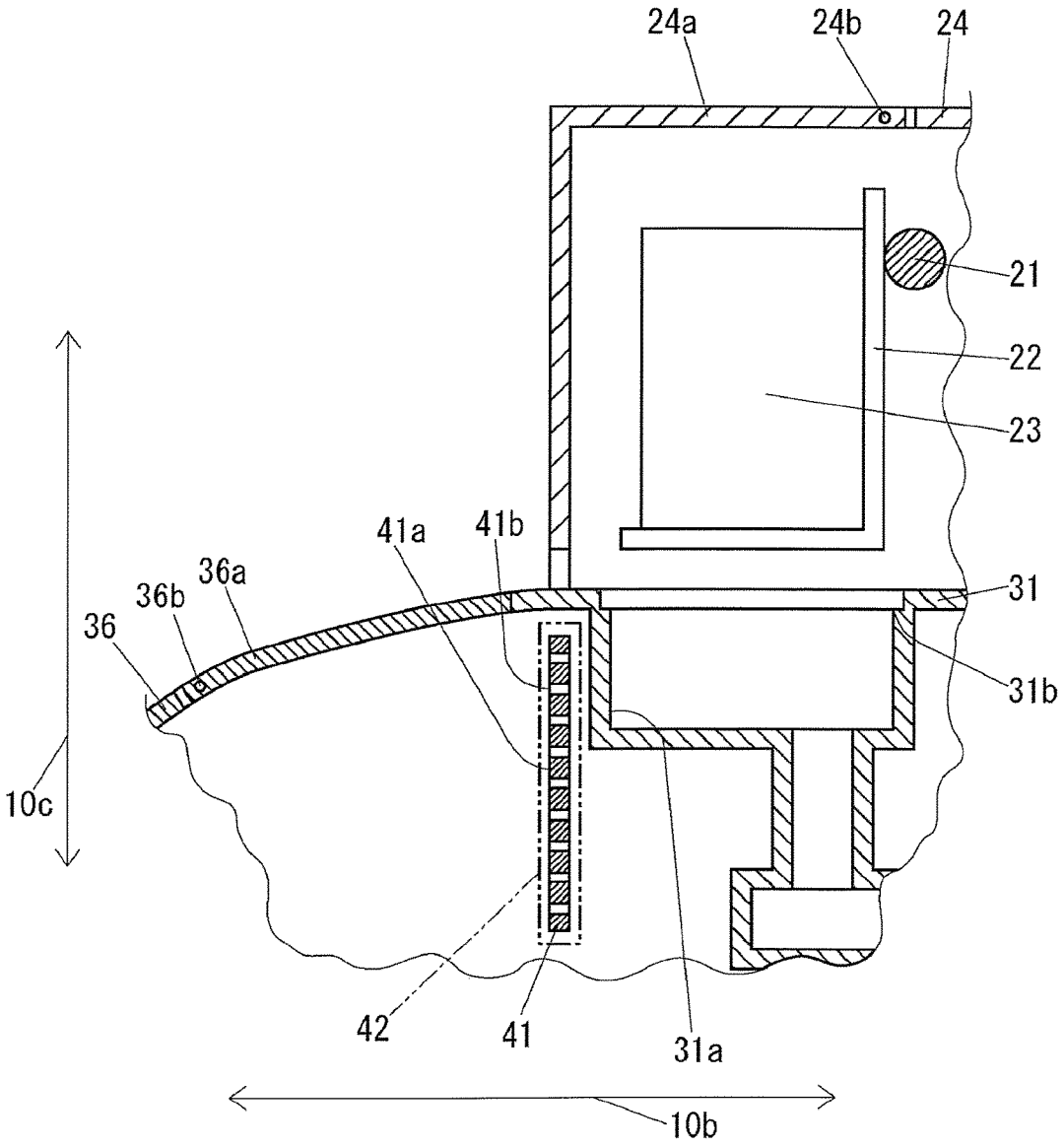
FIG. 9 is a view illustrating an example different from an example shown in FIG. 8(*b*) as a lid storage state.

Also, the inkjet printer 10 is configured to store the lid 41 shown in FIG. 8(*b*) in the storage part 42 such that the lid extends not only in the main scan direction shown by the arrow 10*a* but also in the sub scan direction shown by the arrow 10*b*; however, it may be configured so as to store the lid 41 in the storage part 42 such that the lid becomes a state different from that. FIG. 9 is a view illustrating an example different from the example shown in FIG. 8(*b*), as a lid storage state. For example, the inkjet printer 10 may be configured to store the lid 41 in the storage part 42 such that the lid extends not only in the main scan direction but also in the vertical direction shown by the arrow 10*c* as shown in FIG. 9. Also, the inkjet printer 10 may be configured to store the lid 41 in the storage part 42 such that the lid is inclined, not horizontal as shown in FIG. 8(*b*) and not vertical as shown in FIG. 9. Especially, since the inkjet printer 10 has the link mechanism 50, it is possible to improve the degree of freedom of the storage posture of the lid 41 in the storage part 42, and the internal space of the inkjet printer 10 can be effectively used.

Since the inkjet printer 10 has the storage part 42 for storing the lid 41 detached from the platen 31, it is unnecessary to provide a space for keeping the lid 41 detached from the platen 31 outside the inkjet printer 10. Therefore, the inkjet printer 10 can improve convenience as compared to a configuration which needs to provide a space for keeping the lid 41 detached from the platen 31 outside the inkjet printer 10.

Especially, since the inkjet printer 10 has only one lid 41, the lid 41 is a long part. Therefore, in a case where it is necessary to provide a space for keeping the lid 41 detached from the platen 31 outside the inkjet printer 10, a wide space is required as the space for keeping the lid 41 detached from the platen 31 outside the inkjet printer 10. Therefore, the advantage which is obtained since the inkjet printer 10 has the storage part 42 is great.

Since the inkjet printer 10 has only one lid 41, in a case of performing printing on a non-mesh medium in the state where the lid 41 has been attached to the platen 31, it is possible to uniformize the suction state of the non-mesh medium through the suction holes 41*b* of the lid 41, over the entire lid 41, regardless of place, as compared to a configuration in which a plurality of lids is provided and a gap between lids can be formed. Therefore, it is possible to perform high-quality printing on non-mesh media. Also, since the inkjet printer 10 has only one lid 41, in a case of performing printing on a non-mesh medium in the state where the lid 41 has been attached to the platen 31, it is possible to keep the surface flatness of the entire lid 41 within a specific range, for example, a range equal to or less than 0.5 m, as compared to a configuration in which a plurality of lids is provided and a step between lids can be generated. Therefore, it is possible to perform high-quality printing on the non-mesh medium.

Especially, for example, in a case where the inkjet printer 10 is a large-sized printer configured such that the width of a print medium 90 in the main scan direction shown by the arrow 10*a* can range to 1.8 m to 3 m, or more, although the only one lid 41 provided becomes large and heavy, since it is possible to easily guide an operation of attaching the lid 41 stored in the storage part 42 to the platen 31, and an operation of storing the lid 41 detached from the platen 31 in the storage part 42, by the link mechanism 50, the advantage which is obtained since the inkjet printer has the link mechanism 50 is great.

In a case where the inkjet printer 10 has a plurality of lids arranged in the main scan direction shown by the arrow 10*a*, since the user is required to repeat an operation of attaching a lid to the platen 31 and an operation of detaching a lid from the platen 31, the same number of times as the number of lids, this is troublesome for the user. However, since the inkjet printer 10 has only one lid 41, it is possible to reduce the trouble of the user with respect to the operation of attaching the lid 41 to the platen 31 and the operation of detaching the lid 41 from the platen 31, as compared to a configuration having a plurality of lids arranged in the main scan direction.

Also, the inkjet printer 10 may have a configuration having a plurality of lids arranged in the main scan direction shown by the arrow 10*a*.

The inkjet printer 10 is configured to collect ink having dropped into the groove 31*a* of the platen 31 by the configuration shown in FIG. 2; however, it may have another configuration as a configuration for collecting ink having dropped into the groove 31*a* of the platen 31. For example, the inkjet printer 10 may have a configuration shown in FIG. 10.

Figure 10:
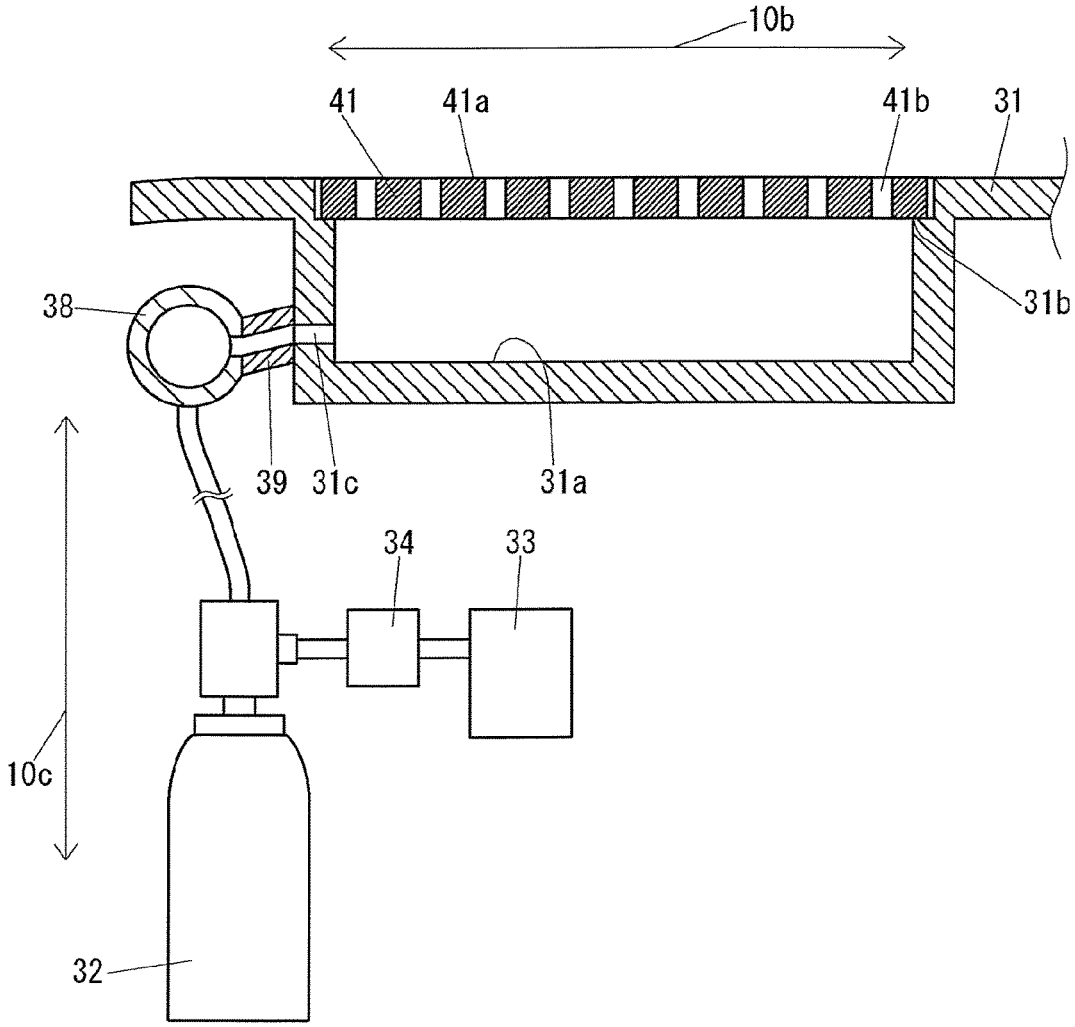
FIG. 10 is a view illustrating an example different from an example shown in FIG. 2 as a configuration for collecting ink having dropped into a groove of the platen.

FIG. 10 is a view illustrating an example different from the example shown in FIG. 2, as a configuration for collecting ink having dropped into the groove 31*a* of the platen 31.

A groove 31*a* of a platen 31 shown in FIG. 10 is different from the groove 31*a* of the platen 31 shown in FIG. 2, and does not have an ink passage on the lower side in the vertical direction shown by the arrow 10*c*. The inkjet printer 10 shown in FIG. 10 has a pipe 38 extending in the main scan direction shown by the arrow 10*a* (see FIG. 1), and a plurality of pipes 39 (in FIG. 10, in a cross section, only one pipe is shown) communicating the inside of the pipe 38 and the groove 31*a* of the platen 31. The pipe 38 is disposed on one side from the groove 31*a* of the platen 31 in the sub scan direction shown by the arrow 10*b*. In the groove 31*a* of the platen 31, a plurality of holes 31*c* for communicating with the insides of the pipes 39 is formed on the side close to the pipe 38. For example, in the platen 31, about twelve holes 31*c* (in FIG. 10, in a cross section, only one hole is shown) having a diameter of about 6 mm are formed in the main scan direction. Also, the air blowing unit 33 is connected to the pipe 38 through the filter 34. Therefore, it is possible to collect ink having dropped into the groove 31*a* of the platen 31 in the ink storage part 32 by sucking air from the inside of the groove 31*a* of the platen 31 by the air blowing unit 33.

(Second Embodiment)

First, the configuration of an inkjet printer according to a second embodiment of the present invention will be described.

Also, in components of the inkjet printer according to the present embodiment, components identical to components of the inkjet printer 10 (see FIG. 1) according to the first embodiment are denoted by the same reference symbols as those of the components of the inkjet printer 10, and a detailed description thereof is omitted.

The inkjet printer 10 (see FIG. 1) of the first embodiment has the downstream-side supporting part 36 (see FIG. 2), the after-heater 37 (see FIG. 2), the lid 41 (see FIG. 2), and the link mechanism 50 (see FIG. 2).

In contrast with this, an inkjet printer 110 of the second embodiment includes two downstream-side supporting parts 136 arranged in the main scan direction shown by the arrow 10*a*, two after-heaters 137 disposed inside the two downstream-side supporting parts 136, respectively, a lid 141 disposed at the center in the main scan direction and two lids 142 disposed with the lid 141 interposed therebetween in the main scan direction, and two link mechanisms 150 disposed so as to correspond to the two lids 142, respectively, instead of such components of the inkjet printer 10 of the first embodiment.

The downstream-side supporting parts 136 are for supporting a print medium 90 on the downstream side from the platen 31 in the conveyance direction of the print medium 90 (see FIG. 1) from the unwinding roller 12 (see FIG. 1) toward the winding roller 13 (see FIG. 1). The downstream-side supporting parts 136 have opening/closing parts 36*a* openable and closeable.

The after-heaters 137 are for drying ink on the print medium 90 supported on the downstream-side supporting parts 136. Also, although not shown, the after-heaters 137 can be installed on the opening/closing parts 36*a*.

The lid 141 and the lids 142 are attachable to and detachable from the platen 31. Each of the lid 141 and the lids 142 has a plurality of suction holes 41*b* formed in its surface 41*a*. The suction holes 41*b* are through-holes for allowing air pass therein from the outside of the groove 31*a* toward the inside of the groove 31*a* in a case where air is sucked from the inside of the groove 31*a* (see FIG. 2) of the platen 31 by the air blowing unit 33 (see FIG. 2) in a state where the lids have been attached to the platen 31.

The link mechanisms 150 constitute a guide mechanism for guiding movement of the lids 142 between the platen 31 and the storage part 42 (see FIG. 2). Each link mechanism 150 has a pair of links 151 disposed so as to be apart from each other in the main scan direction shown by the arrow 10*a* and extending in a direction perpendicular to the main scan direction, and a pair of links 152 connected to the pair of links 151, respectively, so as to be rotatable and extending in the direction perpendicular to the main scan direction.

Each link 151 has a shaft 151*a* provided at one end and extending in the main scan direction shown by the arrow

10*a*, and a shaft 151*b* provided at the other end and extending in the main scan direction. The shaft 151*a* is rotatably supported on a member (not shown) so as not to move in any direction of the main scan direction, the sub scan direction shown by the arrow 10*b*, and the vertical direction shown by the arrow 10*c*, with respect to the downstream-side supporting parts 136.

Each link 152 has one end having a shaft 152*a* extending in the main scan direction shown by the arrow 10*a*, and the other end supported by the shaft 151*b* of the link 151 so as to be rotatable.

Now, attachment and detachment of the lid 141 and the lids 142 relative to the platen 31 will be described.

Figure 11:
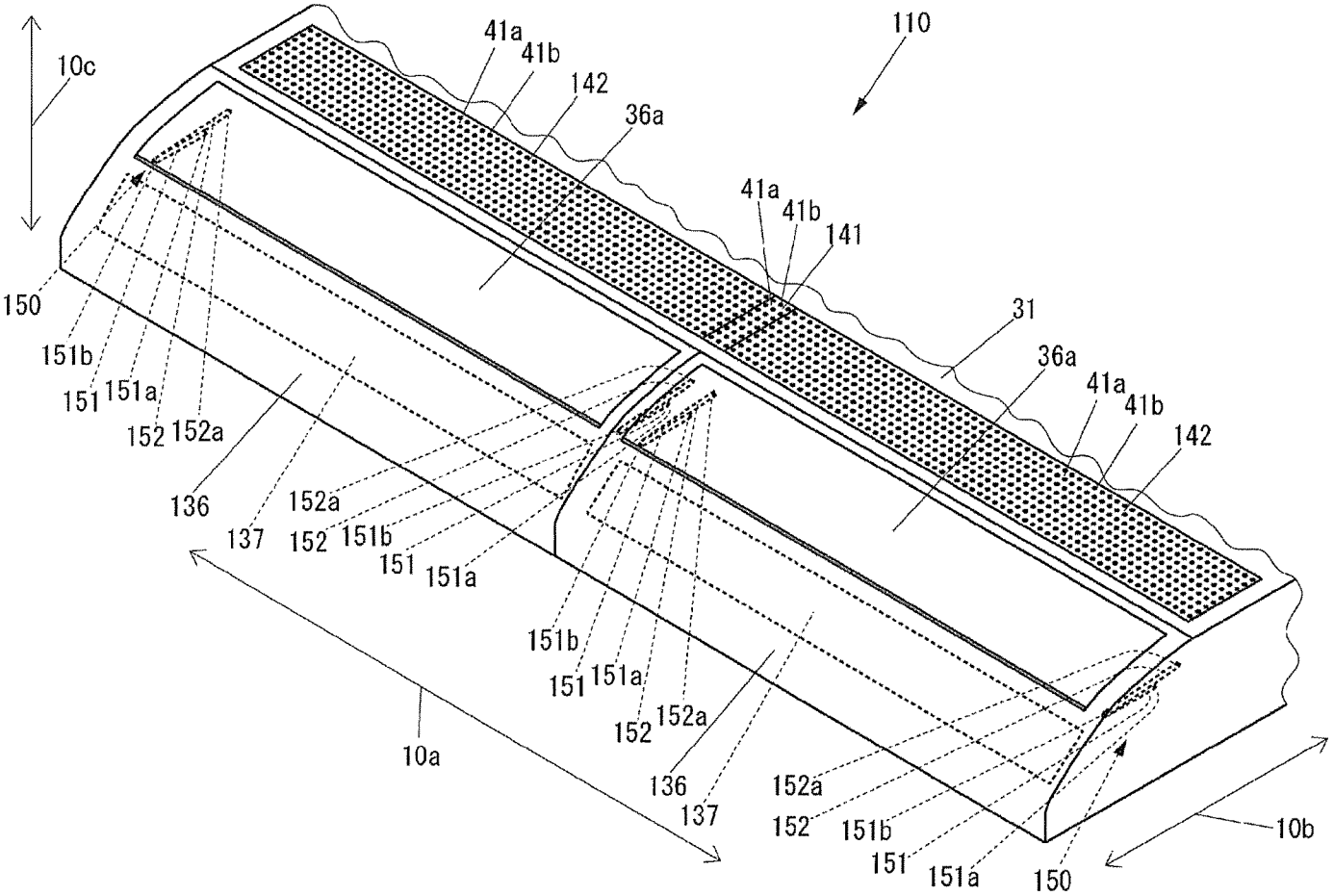
FIG. 11 is a perspective view of a portion of an inkjet printer according to a second embodiment of the present invention.
Figure 12A:
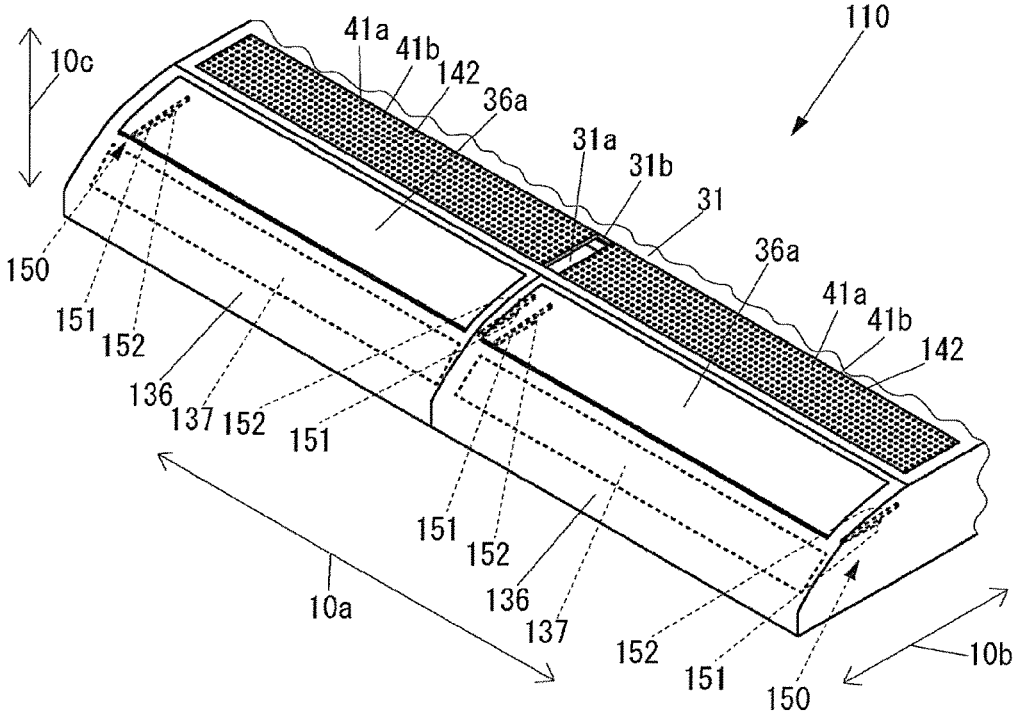
FIG. 12 (*a*) is a view illustrating a first process in a case of detaching lids from a platen shown in FIG. 11.
Figure 12B:
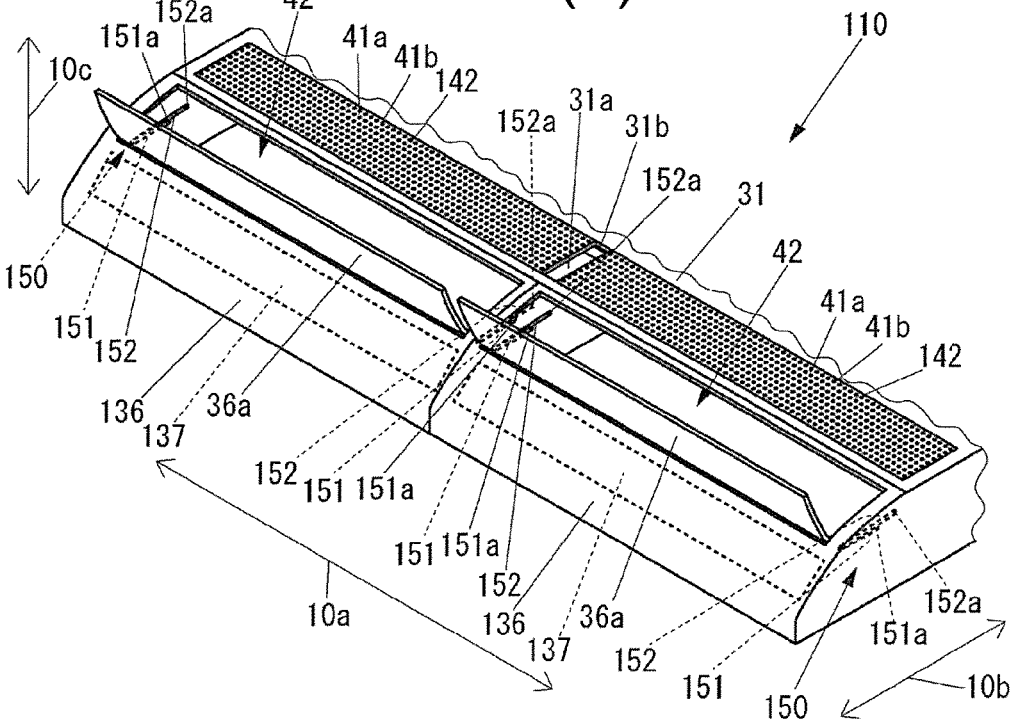
Figure 13A:
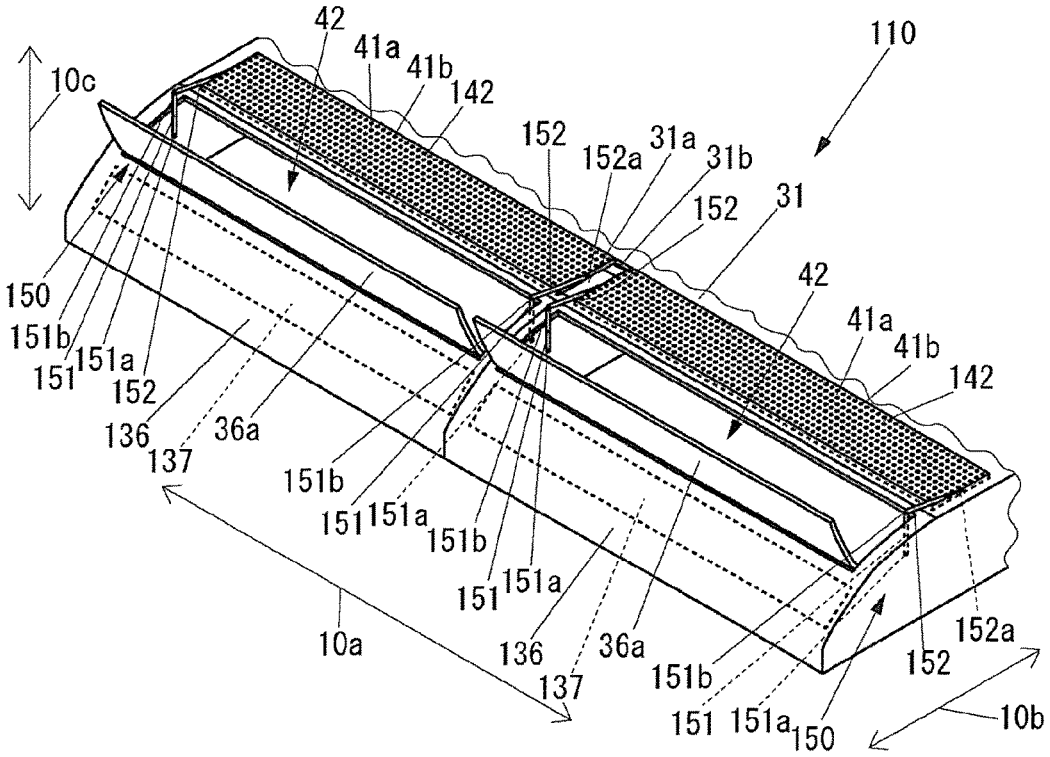
FIG. 13(*a*) is a view illustrating a second process in the case of detaching the lids from the platen.
Figure 13B:
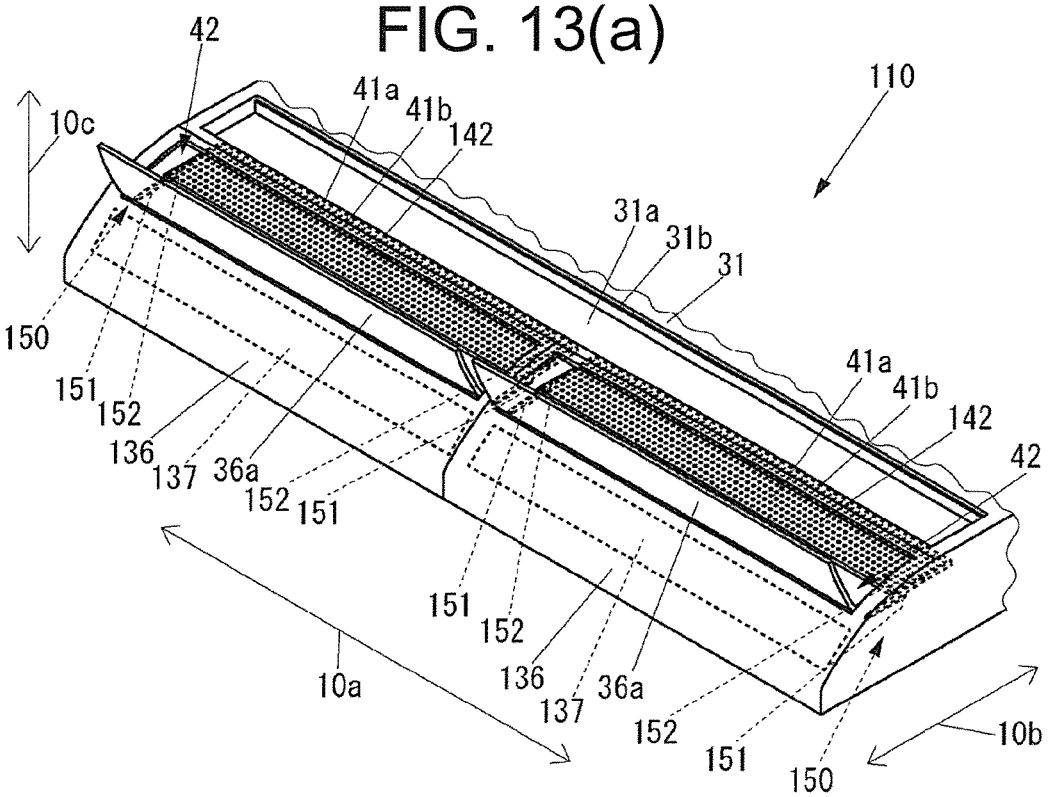
Figure 14:
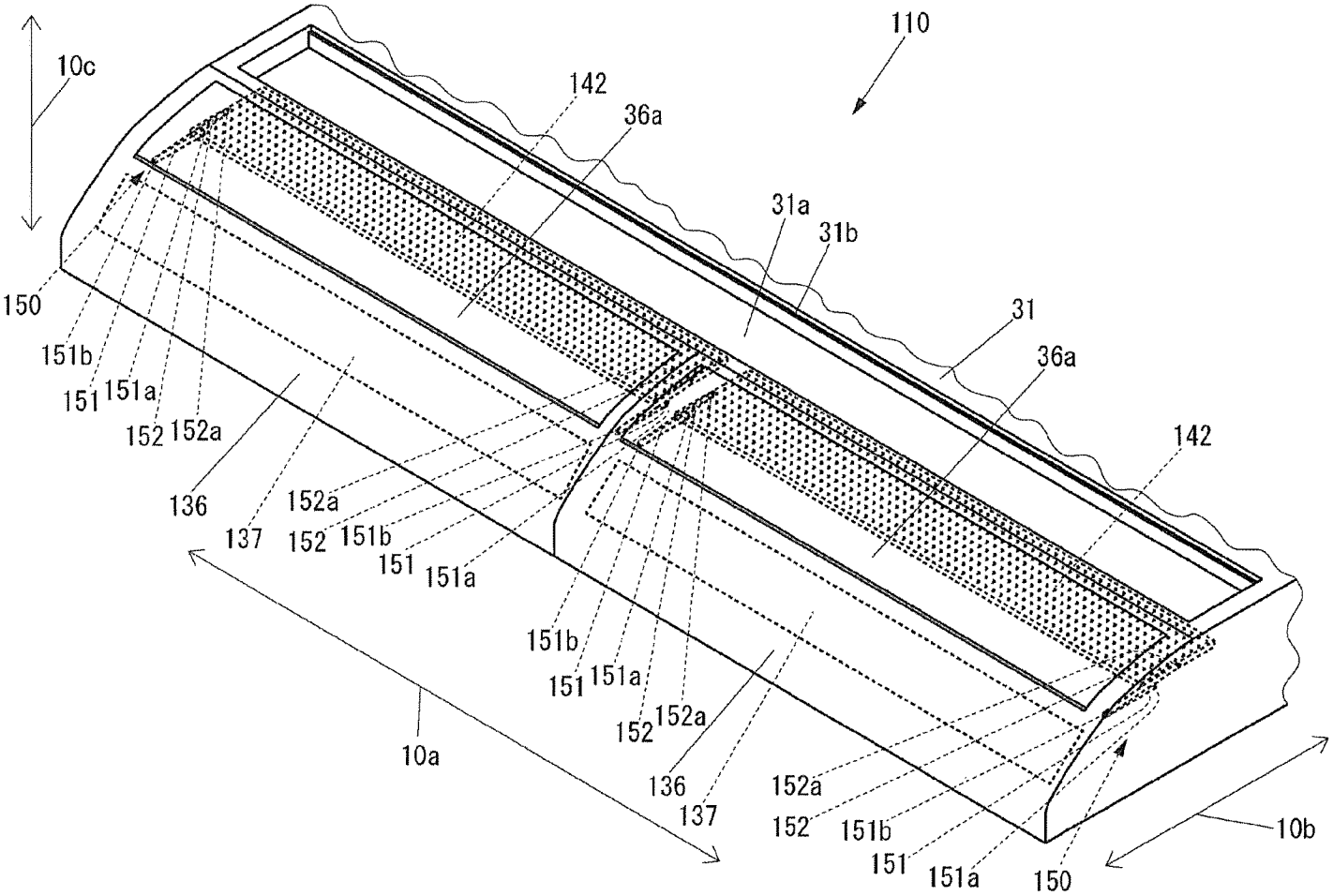
FIG. 14 is a view illustrating a third process in the case of detaching the lids from the platen.

FIG. 12(*a*) is a view illustrating a first process in a case of detaching the lids from the platen shown in FIG. 11. FIG. 12(*b*) is a view illustrating the next process of FIG. 12(*a*). FIG. 13(*a*) is a view illustrating the next process of FIG. 12(*b*). FIG. 13(*b*) is a view illustrating the next process of FIG. 13(*a*). FIG. 14 is a view illustrating the next process of FIG. 13(*b*). In a case of detaching the lid 141 and the lids 142 from the platen 31 from a state where the lid 141 and the lids 142 have been attached to the platen 31 as shown in FIG. 11, first, a user opens the opening/closing part 24*a* as shown in FIG. 7(*a*).

Next, the user moves the lid 141 to a storage position for the lid 141, with the hands. At this time, the inkjet printer 110 becomes a state shown in FIG. 12(*a*). Also, the storage position for the lid 141 may be, for example, the storage part 42.

Next, the user opens the opening/closing parts 36*a* as shown in FIG. 12(*b*).

Next, the user moves the links 152 as shown in FIG. 13(*a*), with the hands, and attaches the shafts 152*a* of the link 152 to both sides of each lid 142 in the main scan direction shown by the arrow 10*a*.

Next, the user moves the lids 142 as shown in FIG. 13(*b*), with the hands, thereby storing them in the storage parts 42, and then closes the opening/closing parts 36*a* as shown in FIG. 14.

Finally, the user closes the opening/closing part 24*a* as shown in FIG. 8(*b*).

In a case of attaching the lid 141 and the lids 142 to the platen 31 from a state where the lids 142 have been stored in the storage parts 42 as shown in FIG. 14, the user can attach the lid 141 and the lids 142 to the platen 31 in the reverse procedure to that in the case of detaching the lid 141 and the lids 142 from the platen 31.

The inkjet printer 110 can further obtain the following effects as compared to the inkjet printer 10 according to the first embodiment. In other words, in the inkjet printer 110, since the link mechanisms 150 are attachable to and detachable from the lids 142, when the link mechanisms 150 do not guide an operation of attaching the lids 142 stored in the storage parts 42 to the platen 31, and an operation of storing the lids 142 detached from the platen 31 in the storage parts 42, it is possible to detach the link mechanisms 150 from the lids 142 and compactly store them as shown in FIG. 11. Therefore, the size of the inkjet printer 110 does not increase as compared to a configuration in which the link mechanisms 150 are not detachable from the lids 142.

Also, the inkjet printer 110 has the configuration having the lid 141 and the two lids 142 arranged in the main scan direction shown by the arrow 10*a*; however, it may have a configuration having only one lid which is long in the main scan direction and the link mechanisms can be attached to and detached from. In a case where the inkjet printer 110 has a configuration in which a number of lid parts are arranged so as to be in contact with each other, since maintenance of surface accuracy or ensuring of airtightness over the entire lid becomes difficult, it is not preferable. Therefore, it is preferable that the inkjet printer 110 have a configuration having only one lid, like the inkjet printer 10 according to the first embodiment. However, in the inkjet printer 110, if necessary, the lid may be divided into a small number of parts. For example, the lid may be divided into about two with the central portion as a boundary, or may be divided into about three like the present embodiment.

The invention claimed is:

1. An inkjet printer for performing printing on a print medium, comprising:

an inkjet head, configured to eject ink drops toward the print medium;

a platen, configured to have a groove formed at a position facing the inkjet head, and support the print medium;

a medium conveyer, configured to convey the print medium supported on the platen;

an air suction device, configured to suck air from an inside of the groove;

a lid, configured to be attachable to and detachable from the platen, and cover an opening of the groove and support the print medium by a surface of the lid when attached to the platen in a case that the print medium is a non-mesh medium;

an upstream-side supporting part, configured to support the print medium and positioned on an upstream side from the platen in a conveyance direction of the print medium, or a downstream-side supporting part, configured to support the print medium and positioned on a downstream side from the platen in the conveyance direction of the print medium;

a storage part, for storing the lid detached from the platen so as to open the groove in a case that the print medium is a mesh medium, wherein the storage part is provided on a lower side in a vertical direction of the conveyance direction of the print medium among the upstream-side supporting part or the downstream-side supporting part; and a guide mechanism, configured to guide movement of the lid between the platen and the storage part, wherein the lid has a plurality of through-holes formed in the surface for allowing air to pass therein from an outside of the groove toward the inside of the groove in a case where air is sucked from the inside of the groove by the suction device in a state where the lid has been attached to the platen, the guide mechanism is a link mechanism, the link mechanism is configured to guide the lid in an operation of attaching the lid stored in the storage part to the platen and an operation of storing the lid detached from the platen in the storage part.

2. The inkjet printer according to claim 1, wherein the link mechanism has a pair of links supported so as to be rotatable around a shaft perpendicular to an extension direction of the links, and the pair of links is disposed in parallel to each other with the lid interposed therebetween, the pair of links have long holes formed so as to face each other, the lid has shaft parts formed on both sides in a direction perpendicular to the extension direction of the links and to be inserted into the long holes so as to be rotatable, and the shaft parts are slidable along the long holes.

3. The inkjet printer according to claim 1, wherein the lid is the only lid which the inkjet printer has.

4. The inkjet printer according to claim 1, wherein the inkjet head is disposed on an upper side in a vertical direction with respect to a conveyance path of the print medium by the medium conveyer, and the storage part is disposed on a lower side in the vertical direction with respect to the conveyance path.

5. The inkjet printer according to claim 1, further comprising:

an attachment/detachment state detector, configured to detect a attachment/detachment state of the lid relative to the platen, wherein, in a case where it is detected by the attachment/detachment state detector that the lid has been attached to the platen, the air suction device sucks air from the inside of the groove with a stronger suction force as compared to a case where it is detected by the attachment/detachment state detector that the lid has been detached from the platen.

* * * * *